US006363849B1

(12) United States Patent
Philipp

(10) Patent No.: US 6,363,849 B1
(45) Date of Patent: Apr. 2, 2002

(54) TAMPON PRINTING MACHINE HAVING LASER ENGRAVING DEVICE

(75) Inventor: Wilfried Philipp, Kornwestheim (DE)

(73) Assignee: Tampoprint GmbH, Korntal-Muenchingen (DE)

( * ) Notice: Subject to any disclaimer, the term of this patent is extended or adjusted under 35 U.S.C. 154(b) by 0 days.

(21) Appl. No.: 09/598,164

(22) Filed: Jun. 21, 2000

(30) Foreign Application Priority Data

Aug. 9, 1999 (DE) ..... 199 37 555
Apr. 12, 2000 (EP) ..... 00107855

(51) Int. Cl.[7] ..... B41F 17/30; B41C 1/05
(52) U.S. Cl. ..... 101/163; 101/401.1; 101/41
(58) Field of Search ..... 101/35, 41, 42, 101/43, 44, 150, 163, 167, 169, 170, 401.1

(56) References Cited

U.S. PATENT DOCUMENTS 4,019,436 A * 4/1977 Handweiler et al. ..... 101/163
5,222,433 A * 6/1993 Philipp ..... 101/163

FOREIGN PATENT DOCUMENTS

DE A1 19531157 2/1997
DE A1 19717653 10/1998
WO WO-0024582 * 5/2000

* cited by examiner

*Primary Examiner*—Leslie J. Evanisko

(57) ABSTRACT

A tampon printing machine has at least one printing plate for having an engraving, an inking device that inks the engraving with printing ink and a printing pad that lifts the ink out of the engraving and transfers it to an object to be printed, wherein a laser engraving device is connected in-line before the inking device.

15 Claims, 3 Drawing Sheets

TAMPON PRINTING MACHINE HAVING LASER ENGRAVING DEVICE

BACKGROUND OF THE INVENTION

The invention involves a tampon printing machine having at least one engraved printing plate, an inking device that inks a gravure engraving with printing ink and a printing pad that lifts the ink out of the engraving and transfers it to an object that is to be printed.

Many tampon printing machines of this type are known in the prior art. In such a printing machine, the printing plate is inked by an inking device, which can be constructed as a closed system or as an open system. After this inking operation, the image to be printed is filled with printing ink which is lifted out using a printing pad, which, for example, can be made of silicone. The ink that adheres to the printing pad is then transferred via the printing pad to an object to be printed. Tampon printing machines of this type can be optimally integrated into production lines, so that products to be printed can be printed immediately after manufacturing or assembly.

From time to time, there is the need to print the same product with different labels or different products with their correspondingly different labels. In order to be able to make available the respective necessary printing images in as short a time as possible, it has been proposed in German patent DE 40 27 587 C1 to construct a printing plate as a foil printing plate and to arrange several images on the printing plate. In this way, by making available respective images that are needed, which is accomplished by shifting the printing plate, the corresponding objects can be provided with the desired prints.

An object of the invention is to make available a tampon printing machine which is more flexible, in particular one that can be rapidly adapted to changing requirements relative to printing images.

SUMMARY OF THE INVENTION

According to principles of this invention for achieving this object, a tampon printing machine of the type mentioned in the opening paragraph includes a laser engraving device connected in-line before an inking device, with which, on the one hand, an engraving can be engraved into a printing plate, and with which, on the other hand, an object to be printed or a printed object, or another object, can be engraved, and a transport device is further included with which the printing plate can be transported from the laser engraving device into an area of the inking device.

A tampon printing machine of the invention is provided with a laser engraving device which gives the printing plate an appropriate engraving prior to an inking of the printing plate. This can be done immediately prior to the inking. After the image is engraved, the printing plate is then transported by a suitable conveyor device from the laser engraving device into an area of the inking device so that the image can be inked. The image is thus engraved into the printing plate by the laser engraving device only shortly prior to the inking operation. In this way, the tampon printing machine can be adapted in a relatively simple and fast manner to different objects to be printed or to different images.

Using the laser engraving device, however, the object that is to be printed or which is already printed can also be engraved, when the need arises. This has the substantial advantage that for preparation of the object to be printed, that is for surface roughing or the like into which the printing ink is subsequently placed, a separate laser station is not necessary. Furthermore, the printed workpiece can be subsequently handled in the same machine, for example, it can be provided with labels or inscriptions. A printing press of the invention additionally creates the possibility of only lasering other objects, which are not to be printed. Objects to be printed can be printed parallel with the lasering.

Advantageously, the position of the laser engraving device relative to the printing pad can be predetermined. In particular, an orientation mark can also be engraved with the laser engraving device, by which the printing plate, for example, can be oriented relative to the inking device and/or the printing tampon by a sensor. The laser engraving device can be completely integrated into the tampon printing machine; however, it is also conceivable that the laser engraving device can be constructed as a separate module that is attachable to the tampon printing machine.

Advantageously, the laser engraving device has a YAG-laser or a $CO_2$-laser. Using these lasers, all laser-capable material can be engraved. In particular, these materials include plastic printing plates and metal foil printing plates.

According to a preferred embodiment, the printing plate is a band printing plate, which is transportable from the laser engraving device in a direction toward the inking device. In this regard, the band printing plate can be unwound from a supply roll and after its use, wound up onto another roll. The band printing plate is thusly pulled a predetermined distance from the supply roll, so that a new image can be lasered onto it. However, it is also conceivable that the band printing plate is drawn off to a greater or lesser distance from the supply roll, depending on the size of the image.

In a preferred embodiment, the laser engraving device and the inking device are arranged between the two rolls. In another embodiment the two rolls are arranged on one side of the machine, in particular on the side that has the laser engraving device. In this way, the possibility is created that the tampon printing machine can be mounted or built both parallel to as well as perpendicularly to a transport direction of a production line.

Another embodiment provides that a printing plate, which is cut to size, can be removed from a stack of printing plates. Non-inscribed printing plates are first located in this stack of printing plates, which are supplied to the laser engraving device so that they can be given the corresponding images. After an engraving, a printing plate is fed to the inking device, so that its image can be inked with printing ink. After use, this printing plate is either sent to a storage area or to a disposal device.

Preferably, a polyester printing plate is used, which, in particular, has a coat of enamel that can be engraved by a laser. Printing plates of this type can be engraved without the edges fraying or the material warping, which would prevent clean wiping by a doctor blade.

Advantageously, the inking device has a drive for an ink fountain, which can be moved in a longitudinal direction or perpendicular direction relative to the transport direction of the printing plate.

Advantageously, the ink fountain can be moved away from the laser engraving device after the inking operation. In this way, it is ensured that not yet used sections of the band-type printing plate are not "dirtied" with printing ink, which could possibly negatively influence a laser operation or an engraving. The ink fountain will thus only be moved back and forth to and from an image to be inked, in a direction of images already inked.

A further embodiment provides that the laser engraving device can be connected to a computer system. Via this computer system, the data for a new image can be entered, that is a customer can either enter the data for the image into the computer system himself, or he can make the data available via a suitable storage medium. In addition, the data for different images can be stored in the computer system, and if necessary, called up in a very short time. Also, data for the engraving of the work pieces and for the printing operation itself can also be entered.

The printing machine of the invention is optimally suited for the purpose of carrying out "just-in-time" printing operations, without having to convert or re-equip the printing machine to do it. In addition, the tampon printing machine is highly flexible and has a high level of integration into the most diverse production lines.

In a further embodiment it is provided that the laser engraving device is constructed for the engraving of printing plates of many tampon printing machines. In this way, an engraving center for printing plates is created which can be applied for various tampon printing machines. The laser engraving device is thus optimally used.

In one embodiment of the tampon printing machine, it is provided that the laser engraving device is set in bearings in one or more carriages, especially so that it can be moved spatially. Preferably, the laser engraving device can also be pivoted in three directions. The laser engraving device can in this way be moved into a laser region for the printing plates and into a laser region for objects. The laser engraving device can in this way be used for engraving objects immediately after their printing plates have been engraved, without any alterations being necessary for this. The tampon printing machine is thus also suitable for small series production.

Preferably, the carriage can be moved into a conveyor area of a transport system for work pieces, for example, a rotary table, a linear conveyor belt, a two-high conveyor belt, or a discontinuous belt. The objects can thus also be brought, in a relatively simple way, during a working cycle, into the working area of the laser engraving device.

BRIEF DESCRIPTION OF THE DRAWINGS

Additional advantages, characteristics and details of the invention are set forth in dependent claims as well as the following description, in which, in reference to the drawings, especially preferred embodiments are set forth in detail. In this regard, the characteristics depicted in the drawings and mentioned in the description and in the claims can be respectively employed according to the invention individually or in desired combinations. Shown in the drawings are:

DETAILED DESCRIPTION OF THE INVENTION

Figure 1:
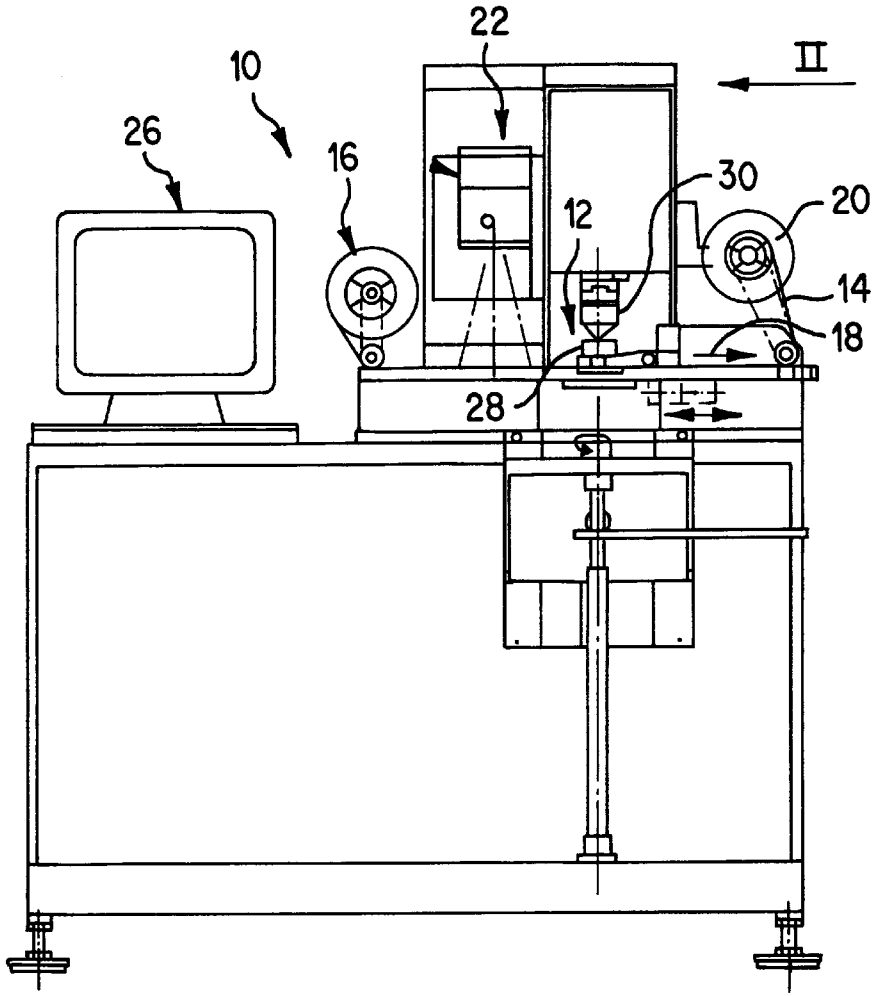
FIG. 1 is a side view of a first embodiment of a tampon printing machine of the invention.

In FIG. 1, a first embodiment of a tampon printing machine, identified generally by 10, is shown according to the first embodiment. This tampon printing machine 10 has a generally-known inking device 12 (see also FIG. 2), with which a band printing plate 14, in particular a gravure engraving on the band printing plate 14, is inked with printing ink. The band printing plate is pulled from a supply roll 16 and fed to a wind-up roll 20 in a direction of an arrow 18. In the process, the band printing plate 14 first passes through a laser engraving device 22, before it passes the inking device 12. A laser 24 is located in the laser engraving device 22, which is controlled by a computer system 26, in particular by a PC. Using the laser 24, an image is engraved into the band printing plate 14 and after the engraving is completed, the band printing plate 14 is transported over a predetermined path, in the direction of the arrow 18, into the inking device 12. There, the engraving is inked with printing ink from an ink fountain 28, which is then lifted, as is generally known, away from the engraving by a tampon 30 and transferred to a object onto which is to be printed. The printing plate, that is this engraving, is inked as long as objects must be printed with the same image. If objects are to be printed with other images, then these other images are engraved by the laser 24 into the band printing plate 14 and the band printing plate 14 is transported in the direction of the arrow 18 over the predetermined path, so that the new image can be inked. The old images are wound up together with the band printing plate 14 onto the wind-up roll 20.

Figure 2:
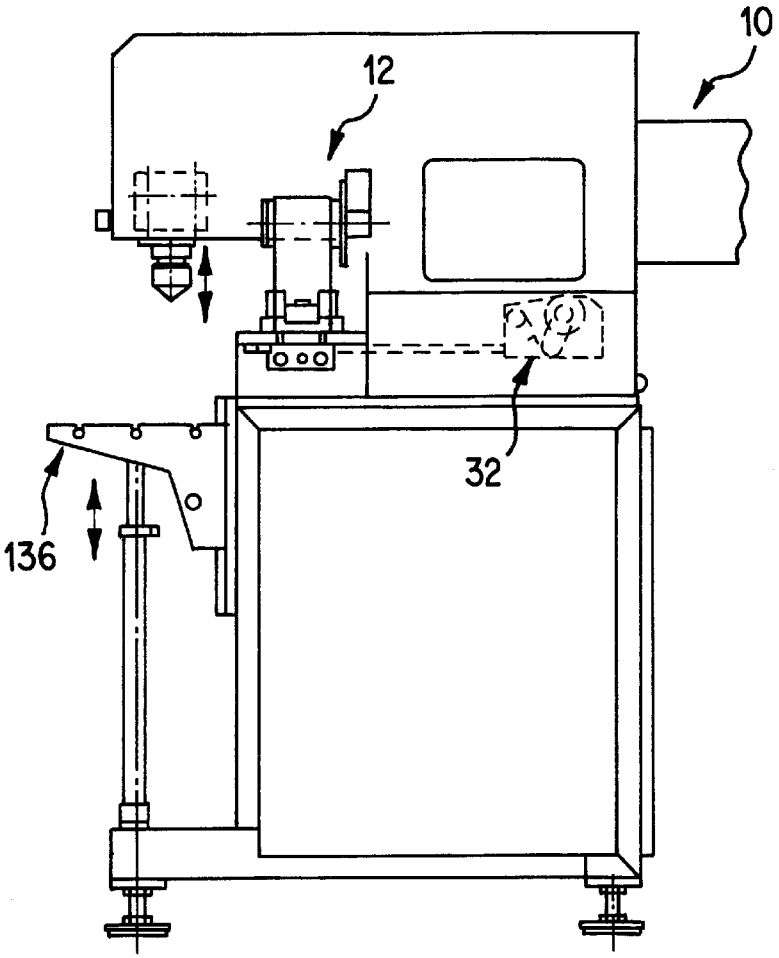
FIG. 2 is a view taken in the direction of the arrow II in FIG. 1 of the tampon printing machine.

The tampon printing machine 10 depicted in FIGS. 1 and 2 has, in addition, a residual ink collector 32, with which, after the objects are printed, the tampon is cleaned of residual ink. An additional path adjustment for a printing carriage that carries the tampon 30 is depicted in FIG. 2, along with a height-adjustable angle table 136. In FIG. 1 it can be clearly seen that the laser engraving device 22 and the inking device 12 are arranged between the two rolls 20.

Figure 4:
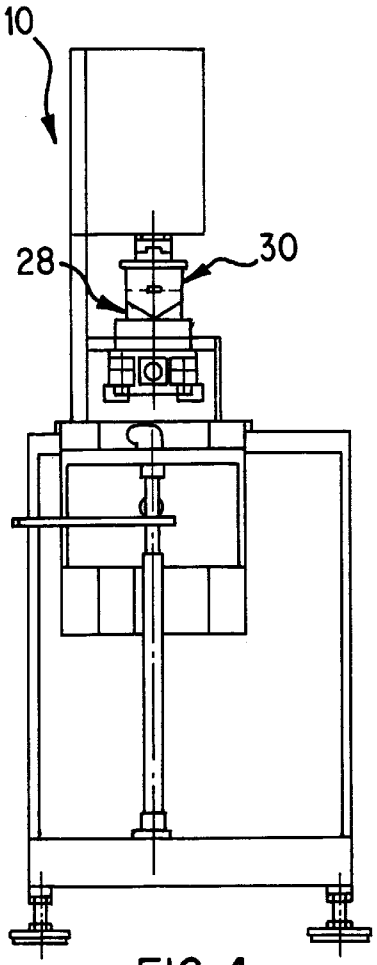
FIG. 4 is a view taken in the direction of the arrow IV in FIG. 3.
Figure 3:
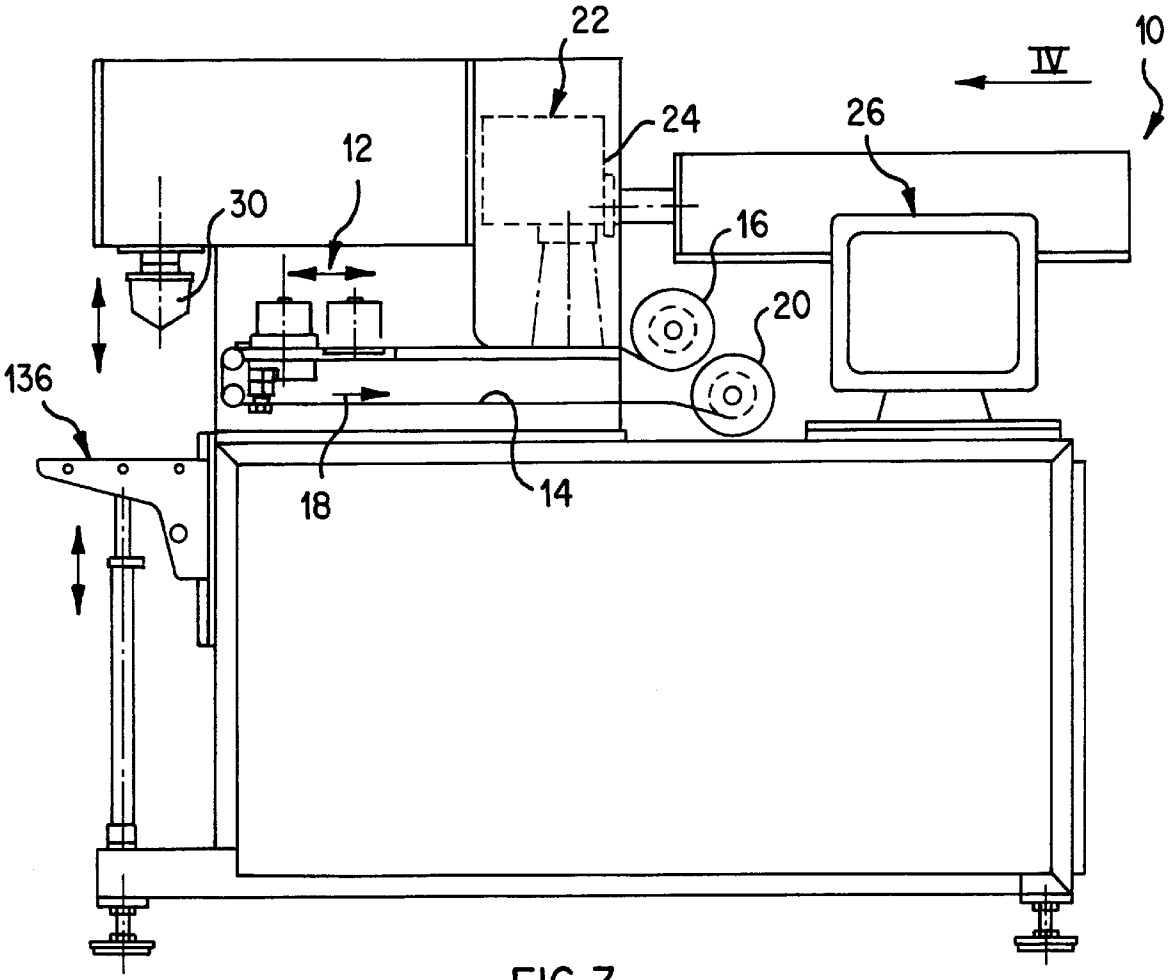
FIG. 3 is a side view of a second embodiment of a tampon printing machine of the invention.

In the embodiment of FIGS. 3 and 4, the two rolls 16 and 20 lie next to each other and the transport direction (arrow 18) of the band printing plate 14 is perpendicular to the transport direction of FIGS. 1 and 2, and is thus perpendicular to a transport direction of the objects to be printed. In this way, the tampon printing machine 10 of FIGS. 3 and 4 is relatively narrow in structure, as can be seen especially in FIG. 4. Also, here, an image is engraved via the laser engraving device 22 into the band printing plate 14, before it is supplied to the inking device 12. The sections of the band printing plate 14, which have no-longer-needed printing images, are fed back below the inking device 12 in the direction to the wind-up roll 20. Also here, the laser engraving device 22 is controlled by a computer system 26 and the images are made available "just-in-time", being engraved into the band printing plate 14 using the laser 24.

Figure 5:
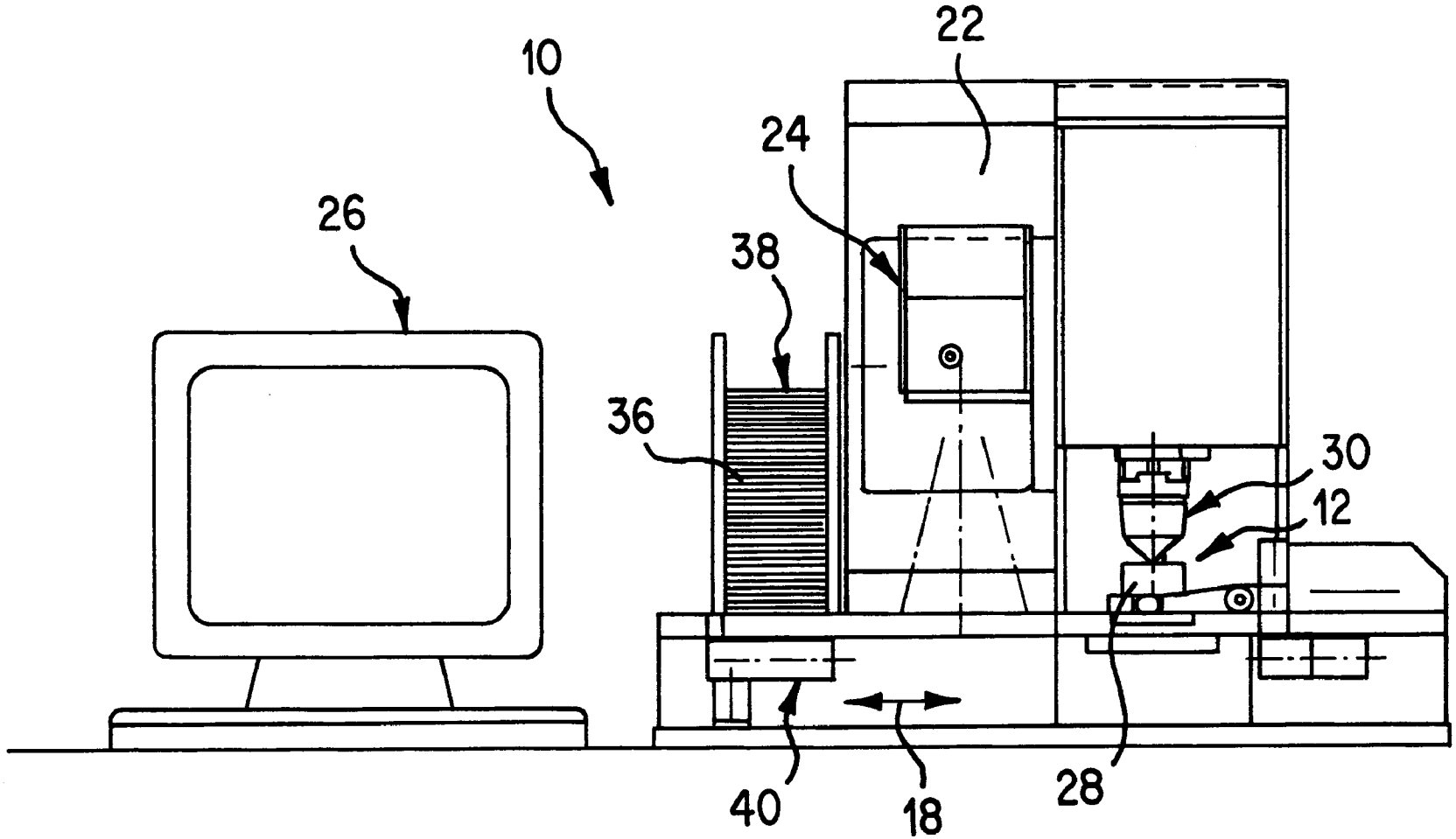
FIG. 5 is a third embodiment of the tampon printing machine of the invention.

In the embodiment of FIG. 5, a band printing plate 14 is not used, rather printing plate blocks 36, are kept in supply in a printing plate stack 38 and removed from this stack. A printing plate transporter 40 functions for this purpose, and supplies the individual printing plate blocks 36 to the laser engraving device 22, so that the image can be engraved using the laser 24. Finally, the engraved printing plate stack 36 is supplied to the inking device 12 and inked using the ink fountain 28. If a new image is necessary, then the printing plate 36 located in the inking device 12 is either fed to another intermediate storage device or to a disposal device and exchanged for a new printing plate block 36 that has the new image.

Using the tampon printing machine 10 of the invention, the respective images are made available "just-in-time", so that different objects can be printed with appropriate images within a very short time.

What is claimed is:

1. Tampon printing machine comprising at least one printing plate (14, 36) for having an engraving, an inking device (12) that inks the engraving with printing ink, a printing pad (30) that lifts the ink out of the engraving and transfers the ink to objects to be printed, wherein a laser engraving device (22) positioned serially before the inking device (12) in a transport direction, for making the engraving in the at least one printing plate (14, 36), and a transport device provided for transporting the at least one printing plate (14, 36) in the transport direction from the laser engraving device (22) to the inking device (12).

2. Tampon printing machine according to claim 1, wherein the printing pad (30) is positioned serially after the inking device.

3. Tampon printing machine according to claim 1, wherein the laser engraving device (22) has one of a YAG-laser and a $CO_2$-laser.

4. Tampon printing machine according to claim 1, further comprising a printing unit, wherein the printing pad is part of the printing unit and wherein the laser engraving device (22) is coupled to the printing unit.

5. Tampon printing machine according to claim 1, wherein the at least one printing plate is a band printing plate (14), which can be transported from the laser engraving device (22) in the transport direction toward the inking device (12).

6. Tampon printing machine according to claim 5, further comprising a supply roll and a wind-up roll, wherein the band printing plate (14) is unwound from the supply roll (16) and after use, wound up onto the wind-up roll (20).

7. Tampon printing machine according to claim 6, wherein the two rolls (16, 20) are arranged on one side of the machine, the one side being the side at which the laser engraving device (22) is arranged.

8. Tampon printing machine according to claim 6, wherein the laser engraving device (22) and the inking device (12) are arranged between the two rolls (16, 20).

9. Tampon printing machine according to claim 1, wherein the at least one printing plate (36) comprises a block adapted to be removable from a stack of printing plates (38).

10. Tampon printing machine according to claim 1, wherein the at least one printing plate (14, 36) is one of a plastic printing plate and a metal foil printing plate.

11. Tampon printing machine according to claim 1, wherein the at least one printing plate (14, 36) has a coat of enamel that can be engraved by the laser engraving device.

12. Tampon printing machine according to claim 1, wherein the inking device (12) comprises an ink fountain and has a drive for the ink fountain (28), which can be moved in a longitudinal direction and perpendicular direction relative to the transport direction (18) of the at least one printing plate (14, 36).

13. Tampon printing machine according to claim 1, wherein the inking device (12) comprises an ink fountain and has a drive for the ink fountain (28) and wherein the ink fountain (28) can be moved away from the laser engraving device (22) after the engraving in the at least one printing plate is inked.

14. Tampon printing machine according to claim 1, further comprising a computer system and wherein the laser engraving device (22) is connected to the computer system (26).

15. Tampon printing machine according to claim 1, wherein the at least one printing plate is of polyester.

* * * * *